United States Patent [19]

Simo

[11] Patent Number: 4,676,512

[45] **Date of Patent: * Jun. 30, 1987**

[54] ARROWHEAD

[76] Inventor: Miroslav A. Simo, 370 N. Delaplaine Rd., Riverside, Ill. 60546

[ * ] Notice: The portion of the term of this patent subsequent to Jul. 16, 2002 has been disclaimed.

[21] Appl. No.: 753,790

[22] Filed: Jul. 11, 1985

Related U.S. Application Data

[63] Continuation-in-part of Ser. No. 580,722, Feb. 16, 1984, Pat. No. 4,529,208.

[51] Int. Cl.[4] ..... F41B 5/02

[52] U.S. Cl. ..... 273/422

[58] Field of Search ..... 273/416, 418–422; D22/21

[56] References Cited

U.S. PATENT DOCUMENTS

| | | | |
|---|---|---|---|
| 2,930,620 | 3/1960 | Brooks | 273/422 |
| 3,618,948 | 11/1971 | McGlocklin | 273/421 |
| 3,910,579 | 10/1975 | Sprandel | 273/422 |
| 3,915,455 | 10/1975 | Savora | 273/422 |
| 4,093,230 | 6/1978 | Simo | 273/421 |
| 4,341,391 | 7/1982 | Anderson | 273/422 |
| 4,452,460 | 6/1984 | Adams | 273/422 |
| 4,529,208 | 7/1985 | Simo | 273/422 |
| 4,570,941 | 2/1986 | Saunders | 273/422 |

FOREIGN PATENT DOCUMENTS

| | | | |
|---|---|---|---|
| 2250090 | 5/1975 | France | 273/416 |

OTHER PUBLICATIONS

Super Hilbre Arrowhead.
Bear Razor Arrowhead.

*Primary Examiner*—Paul E. Shapiro
*Attorney, Agent, or Firm*—Thomas W. Speckman

[57] ABSTRACT

An arrowhead for archery arrows having a plurality of blades wherein the blade carrying body for at least a portion of its length has a reduced cross section area less than that of a circumscribing circle having a center at the center of mass of the blade carrying body at that section, providing reduced radial surface area and deeper target penetration.

50 Claims, 25 Drawing Figures

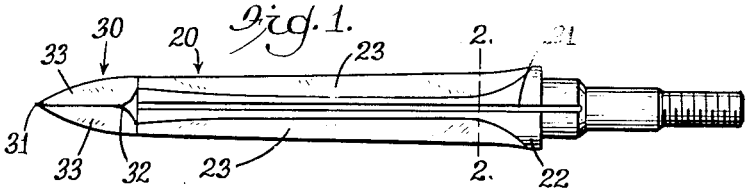
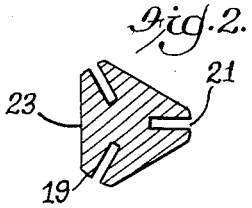
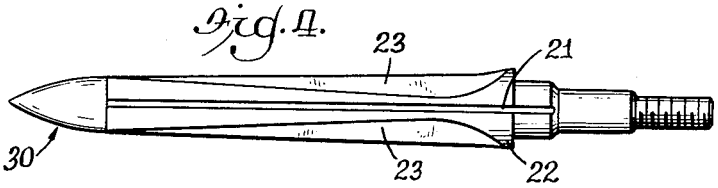
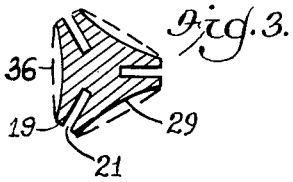
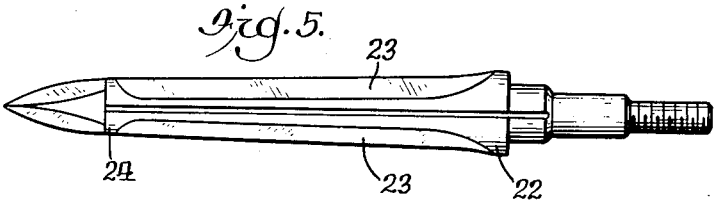
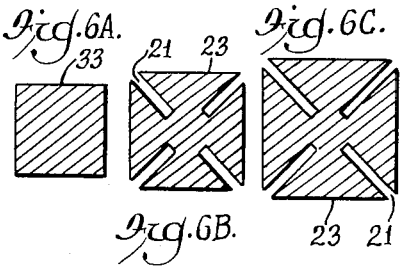
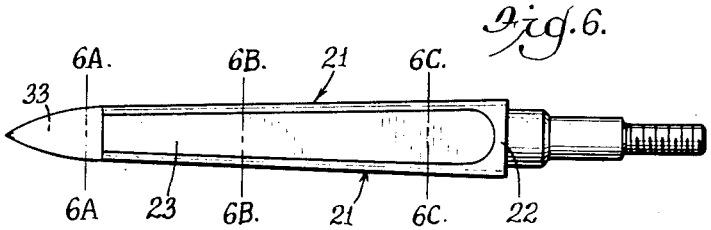
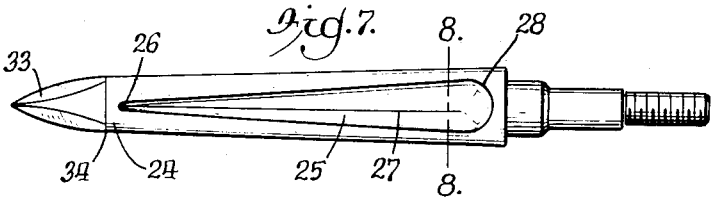
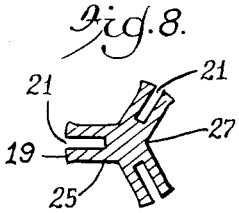
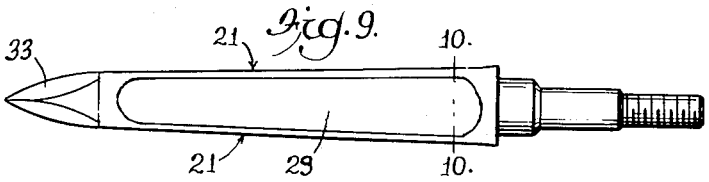
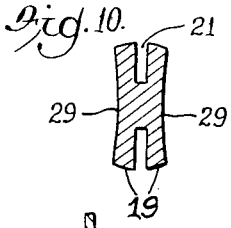
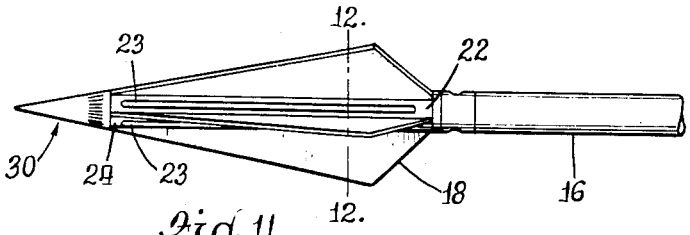
Fig. 11.
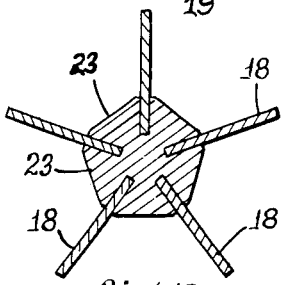
Fig. 12.

ARROWHEAD

CROSS REFERENCE TO RELATED APPLICATION

This application is a continuation-in-part of my copending application Ser. No. 580,722, filed Feb. 16, 1984, U.S. Pat. No. 4,529,208.

BACKGROUND OF THE INVENTION

1. Field of the Invention

This invention relates to an arrowhead having deep penetration of a target and which is useful for hunting using a bow and arrow.

2. Description of the Prior Art

A wide variety of arrowheads having a plurality of sharpened blades are well known to the art. Some of the arrowheads in which the blades are removable and are carried in a blade carrying body for their full length are exemplified by U.S. Pat. Nos. 4,381,866; 4,036,499; 3,915,455 and 2,940,758 showing radially mounted blades and U.S. Pat. No. 4,210,330 showing non-radially mounted blades. Multiple blade arrowheads in which a plurality of blades are permanently mounted in a blade carrying body for the entire length of the blade are exemplified by U.S. Pat. Nos. 4,203,601; 4,175,749; 4,093,230 and 4,006,901. Another class of hunting arrowheads have blades which are mounted in their rear portion on a blade carrying body with the forward portion of the blade forming the point as exemplified by U.S. Pat. Nos. 3,854,723; 2,909,372 and 2,925,278, and arrowheads having only the rear and front portions of their blades mounted in a blade carrying body as shown in U.S. Pat. No. 4,341,391. These hunting arrowheads are generally referred to as flatheads, particularly when they involve a single sheet of metal forming two blades. U.S. Pat. No. 3,618,948 teaches an arrowhead having a rotatable circular cutting member mounted in a slot in a ferrule. In one embodiment having a point with a plurality of sides or faces, the rotating cutting member is aligned with the flat faces. In another embodiment without a point, the rotating cutting member extends beyond the front of the ferrule and the front of the ferrule has tapered sides to form a sharpened frontal area.

In the above prior art, particularly in the cases where the blades are held for their entire length in blade carrying slots in a blade carrying body, or ferrule, the blade carrying bodies are all of circular cross section and are generally tapered in a straight line, convexly or concavely to fair into the point at the head end and to fair into the arrow shaft at the rear end.

SUMMARY OF THE INVENTION

This invention relates to an arrowhead on the forward end of an archery arrow of the type having an elongated blade carrying body in which a plurality of blades are mounted in the blade carrying body. The blades may be arranged in radial or non-radial orientation and the blades may engage blade carrying slots for their full length or only at one or both the head or tail ends. The blade carrying body may be the head end of the arrow shaft or may be a separate ferrule. All of the prior art arrowheads referred to above, as well as any other arrowhead in which blades are attached to a blade carrying body are suitable designs for application of this invention. This invention provides that at least a portion of the length of the blade carrying body, preferably more than about 25 percent and most preferably more than 60 or 80 percent of the length, has a reduced cross section area less than that of a circumscribing circle having a center at the center of mass of the blade carrying body at that section and a radius equal to the distance from the center of mass to the junction of the blades with the surface of the blade carrying body. The blades, therefore, are in the thickest portion of the blade carrying body which provides deep anchoring of the blades. In various embodiments, the surfaces forming the perimeter of that cross section area between adjacent blades may be flat, concave, convex, or V-grooved for a substantial portion of those surfaces. The reduced cross section provides less surface between the blades than the circumscribing circle. The arrowhead tip may have a conical point or may have a tapered point of polygonal cross section. A tapered point of polygonal cross section may have a number of sides corresponding to the number of blades and the edges of the point may be aligned with the blades and the flats of the point aligned with and faired into the outer surface of the front of the blade carrying body between the blade mountings. The reduced cross-sectional area may be continued through any structure between the blade carrying body and the arrow shaft and/or into the forward end of the shaft itself. The arrowhead of this invention shows deeper target penetration than similar arrowheads wherein the blade carrying body is of circular cross section. The arrowhead of this invention is suitable for carrying 2 to 7 blades, 3 to 5 blades being preferred. By the number of blades, I mean each extension of a blade from the blade carrying body; that is, a single blade structure extending through and outwardly from both sides of an arrow carrying body is two blades. The blades may be fixedly attached or may be removable.

Accordingly, one object of this invention is to provide an arrowhead having deeper target penetration than prior arrowheads, particularly those of the type having a separate blade carrying body or ferrule with removable blades retained in slots for the full length of the ferrule.

Another object of this invention is to provide an arrowhead with a blade carrying body having for at least a portion of its length a reduced cross sectional area less than that of a circumscribing circle.

Another object of this invention is to provide an arrowhead wherein the blade carrying body for a portion of its length between adjacent blades has a flat outer surface.

It is yet another object of this invention to provide an arrowhead wherein the blade carrying body for a portion of its length between adjacent blades has a convex outer surface.

It is yet another object of this invention to provide an arrowhead wherein the blade carrying body for a portion of its length between adjacent blades has a V-grooved outer surface.

It is still another object of this invention to provide an arrowhead having a tip with a tapered point of polygonal cross section, the number of sides of the polygonal cross section corresponding to the number of blades and the sides of the polygonal cross section of the tip being aligned with and faired into the outer surface of the front of the blade carrying body between the blade mountings.

Yet another object of this invention is to continue the above described reduced cross section to a structure between the blade carrying body and the arrow shaft and/or into the forward end of the shaft.

BRIEF DESCRIPTION OF THE DRAWING

The objects and other objects and advantages of the invention will become more apparent from disclosure of preferred embodiments in reference to the drawings wherein:

FIG. 1 is a side view of a triangular shaped arrow carrying body according to one embodiment of this invention;

FIG. 2 is a cross section as shown at 2—2 in FIG. 1;

FIG. 3 is a cross section in the same plane as FIG. 2 showing concave and convex surfaces between the blade carrying slots;

FIG. 4 is a side view of another embodiment of this invention showing the surfaces between the blade carrying slots fairing into a conical point;

FIG. 5 is the side view of another arrowhead according to this invention showing fairing of the front of the blade carrying body into a rounded surface of a polygonal tapered point;

FIG. 6 is the side view of 4-bladed arrowhead showing alignment of a polygonal shaped tip with the flattened surfaces of the blade carrying body between the blades;

FIGS. 6A, 6B and 6C are sectional views as shown by lines 6A—6A; 6B—6B and 6C—6C in FIG. 6;

FIG. 7 is the side view of another arrowhead according to this invention showing a V groove between blade carrying slots;

FIG. 8 is a cross-sectional view at 8—8 in FIG. 7;

FIG. 9 is a side view showing a 2-bladed arrowhead according to this invention;

FIG. 10 is a cross section view at line 10—10 shown in FIG. 9;

FIG. 11 is a side view of a 5-bladed arrowhead according to one embodiment of this invention showing blades in place and the point and arrow shaft in place;

FIG. 12 is a sectional view along line 12—12 of FIG. 11;

DESCRIPTION OF PREFERRED EMBODIMENTS

Figure 13:
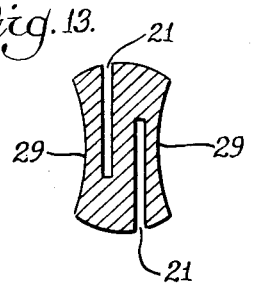
FIGS. 13-16 are sectional views of other two bladed arrowheads of this invention.

Referring to FIGS. 1 and 2, arrowhead blade carrying body 20 has blade slots 21 and flats 23 between adjacent blade slots 21. As shown in FIG. 1, the rear end of arrowhead blade carrying body 20 has fairing portion 22 fairing into the adjacent front end of the arrow shaft. While the terminology "adjacent" is used here, it is recognized that there may be rings or other structures between the end of arrowhead blade carrying body 20 and the arrow shaft as taught by U.S. Pat. No. 4,381,866 or an adapter or filler washer as taught by U.S. Pat. No. 4,006,901. As shown in FIG. 1, flats 23 extend to the front end of blade carrying body 20 and are adapted to fair into wedge-shaped polygonal cross section arrowhead tip 30. Arrowhead tip 30 in one embodiment of this invention as shown in FIG. 1, has point 31, flats 33 and tapered fairing portion 32. In FIG. 1, flats 33 of tip 30 are aligned with flats 23 of blade carrying body 20. This alignment is a part of the invention, but the number of flats on the tip may be different from and not aligned with the flats on the blade carrying body. FIG. 2 shows a preferred embodiment wherein blade carrying body 20 has narrow blade carrying portion 19 adjacent each side of the blade carrying slots 21. As seen in FIGS. 3, 8 and 10, blade carrying portion 19 becomes more important when the outer surfaces of blade carrying body 20 are concave as shown in FIG. 3, or V-grooved as shown in FIG. 8, or only 2 blades are used as shown in FIG. 10. The thickness of blade carrying portion 19 adjacent to slots 21 is not important to this invention and the outer surface of the blade carrying body may come to a sharp point at its juncture with slots 21, as shown in FIGS. 6B and 6C.

Figure 22:
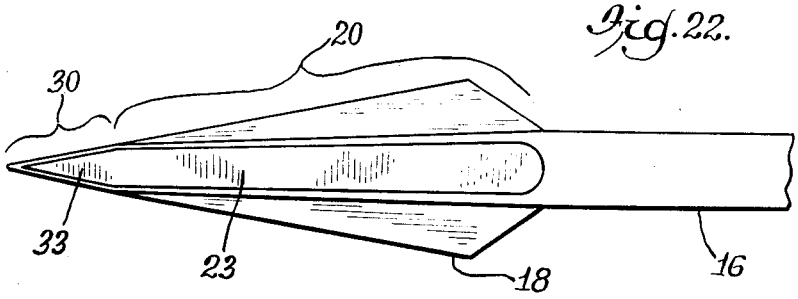
FIG. 22 is a side view showing a blade carrying body as an integral part of the forward end of the arrow shaft.

Blade carrying body 20 may be an integral part of the forward end of the arrow shaft, as shown in FIG. 22, or may be a separate detachable blade carrying body. Neither the manner of attachment of the blade carrying body to the arrow shaft nor the manner of attachment of the blades to the blade carrying body is of importance in this invention. Likewise, this invention is applicable to flattened broad head type arrowheads wherein only a rear portion of the blades are mounted on the blade carrying body as disclosed in patents referred to in the prior art section above. The term "blade carrying body" as used throughout this description and claims is intended to mean that structure to which the blades of the arrowhead are attached, and in the case of a blade carrying body being the forward end of the arrow shaft itself, the term is meant to include that portion of the shaft forward of the rear attachment of the blades.

It is an important aspect of this invention that the blade carrying body for at least a portion of its length has a reduced cross section area less than that of a circumscribing circle having a center at the center of mass of the blade carrying body at that section. The surfaces forming the perimeter of the cross section area between the blades may be flat, convex, concave, V-grooved or any combination of these surfaces for a substantial portion of the surface to form the reduced cross section area. The terminology "substantial portion of the surface" means that the surface forming the reduced area between blades extends for a major portion of the distance between adjacent blades in at least some sections and is not meant to include small grooves extending for only a small fraction, in the order of under 25 percent, of the distance between adjacent blades. In several embodiments, a multiplicity of such surfaces may form extending sharp edges on the blade carrying body between adjacent blades. The blade carrying bodies according to this invention may be constructed of any suitable durable material known to the art, usually synthetic polymers or metallic materials.

Arrowhead tip 30 may be a unitary structure with blade carrying body 20 or may be a separate tip 30 attached in any suitable manner to blade carrying body as, for example, exemplified by U.S. Pat. Nos. 4,381,866 and 4,006,901. The arrowhead tip may also be the forward end of a blade carrying body which does not extend for the full length of the blades, as in the flatheads described above. Arrowhead tip 30 may be conical as shown in FIG. 11, may be bulged conical as shown in FIG. 4, or may have flat or concave surfaces 33 extending from point 31 to a circular section fairing portion 34, as shown in FIG. 7, fairing into blade carrying body 20, or as described above with respect to FIG. 1 and as seen in FIGS. 6, 6A, 6B and 6C, may have flats or grooves corresponding to and aligned with flats or grooves in blade carrying body 20. Arrowhead tip 30 may be of tapered or polygonal cross section having 2 to 7 sides which may or may not coincide to the number of blade carrying slots.

FIG. 3 shows embodiments of this invention for 3-bladed arrowheads; the solid lines showing concave surfaces 29 between adjacent blades and the dashed lines showing convex surfaces 36 between adjacent blades.

FIGS. 6, 6A, 6B and 6C show one embodiment of a 4-bladed arrowhead according to this invention wherein the blade carrying body has flats 23 extending between blade carrying grooves 21 for almost its full length, tapering only at the rear portion to form fairing portion 22 for fairing to the shaft. The tip has four correspondingly tapered flats 33 matching flats 23 of the arrow carrying body. In this embodiment the reduced cross-sectional area of the blade carrying body extends for well over 90 percent of its length.

FIGS. 7 and 8 show another embodiment of this invention wherein the blade carrying body has V grooves 25 between adjacent blade carrying slots 21, V grooves 25 being faired into circular fairing portion 24 to meet circular end section 34 of the tip and into circular fairing portion 28 fairing into the arrow shaft.

FIGS. 9 and 10 show a 2-bladed embodiment of an arrowhead according to this invention having concave portions 29 between adjacent blade carrying portions 19. The arrowhead tip shown in FIG. 9 has tapered flat surfaces 33 which do not correspond with the concave surfaces 29 of the arrowhead body.

FIGS. 11 and 12 show an embodiment of this invention of an arrowhead having 5-blades with flats 23 extending between the blades and a straight sided conical arrowhead tip 30. In FIG. 11 blades 18 are fixedly attached to the arrowhead body and the arrowhead body has fairing portion 22 matching the cross section of arrow shaft 16.

Figure 14:
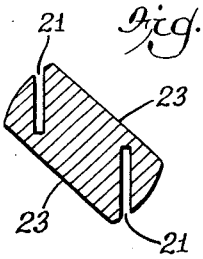

FIG. 13 shows an embodiment of this invention wherein the blade carrying body has non-radial oriented blade slots 21 and concave surfaces 29 adjoining the circular arc from the open end of the blade carrying slots. FIG. 14 shows another embodiment of a 2-bladed arrowhead according to this invention wherein blade carrying slots 21 are oriented in a non-radial relationship and flat surfaces 23 join the circular arcs extending from the open end of blade slots 21.

Figure 15:
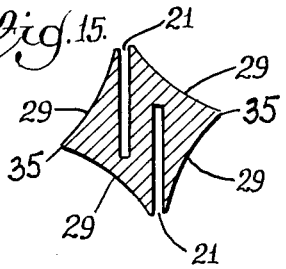
Figure 16:
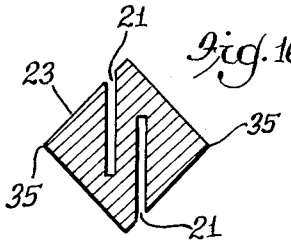

FIGS. 15 and 16 show another embodiment of this invention wherein blade slots 21 are oriented in a non-radial arrangement. In FIG. 15 multiple concave surfaces 29 are between adjacent blade slots 21 and form extending sharp edges 35. FIG. 16 shows multiple flat surfaces 23 between adjacent blade slots 21 forming extending sharp edges 35.

Figure 17:
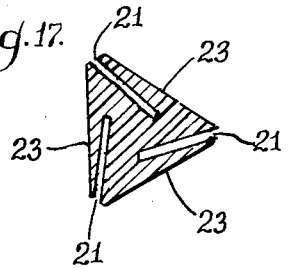
FIG. 17 is a sectional view of a 3-bladed arrowhead of this invention having non-radial blades.
Figure 18:
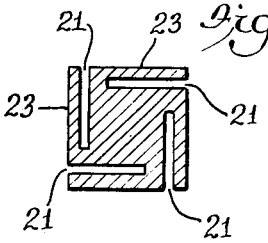
FIG. 18 is a sectional view of a 4-bladed arrowhead of this invention having non-radial blades.

FIGS. 17 and 18 illustrate other embodiments of this invention having non-radially oriented blade slots 21 and flat surfaces 23 between adjacent blade slots, forming a generally triangular shape in FIG. 17 with three blade slots and a generally square shape in FIG. 18 with four blade slots.

Figure 19:
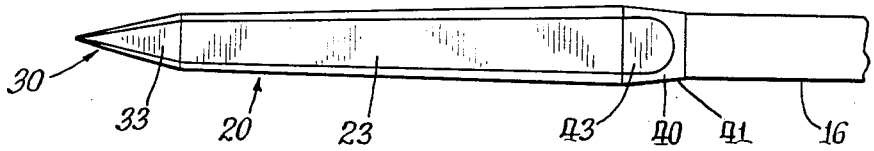
FIG. 19 is a side view of an arrowhead with flattened surfaces between the blades with the flattened surfaces continuing for the length of the point and for a substantial portion of an adapter portion of an insert between the blade carrying body and the arrow shaft.

FIG. 19 shows blade carrying body 20 with flat surfaces 23 extending for the entire length of blade carrying body 20 and continuing forwardly as flat surfaces 33 in point 30 and continuing rearwardly as flat surfaces 43 in adapter 40. Adapter 40 may be part of an insert fitting into a bore in the forward end of arrow shaft 16 or may be a sleeve structure fitting between the rear end of blade carrying body 20 and the forward end of arrow shaft 16. Adapter 40 may have decreasing surface 41 as shown in FIG. 19 or increasing surface 42 as shown in FIG. 20.

Figure 20:
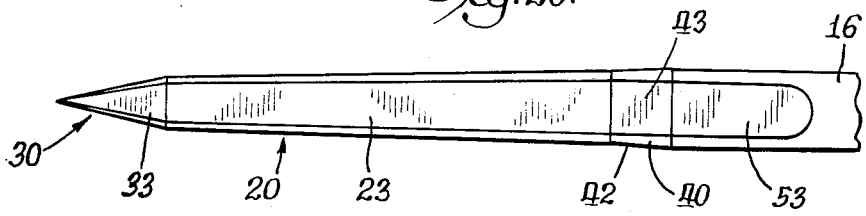
FIG. 20 is a side view similar to FIG. 19 showing flattened surfaces continuing into the forward end of the arrow shaft.

FIG. 20 shows adapter 40 with flat surfaces 43 extending for the full length of adapter 40 and continuing as flat surfaces 53 into the forward end of arrow shaft 16. Flat surfaces 53 may extend for any desired length in arrow shaft 16, normally extending for less than about 25 percent the length of arrow shaft 16.

Figure 21:
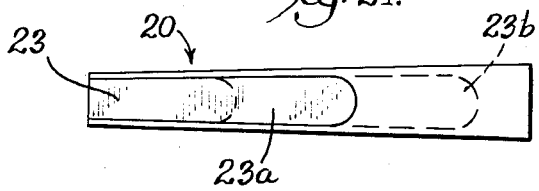
FIG. 21 is a side view of a blade carrying ferrule showing flattened surfaces extending for different distances according to this invention.

FIG. 21 shows blade carrying body 20 with flat surface 23 extending for about 25 percent of its length; flat surface 23+23*a* extending for about 60 percent of its length; and flat surface 23+23*a*+23*b* extending for about 80 percent of its length. Thus, the flat surfaces 23 preferably extend for any desired portion of the length of blade carrying body 20 from about 25 percent as shown in FIG. 21 to the full length as shown in FIGS. 19 and 20.

FIG. 22 shows blade carrying body 20 and tip 30 as an integral part of arrow shaft 16 and having flat surface 23 continuing as flat surface 33 on point portion 30.

The reduction of the cross section area to less than that of a circumscribing circle having a center at the center of mass of the blade carrying body at that section and a radius equal to the distance from the center to the junction of the blades with the surface of the blades for at least a portion of its length provides an arrowhead having deeper target penetration than prior art arrowheads having generally circular cross sections at corresponding locations. The reduced cross section provides less radial surface than the circumscribing circle between the blades as opposed to reduction in frontal surface obtained by the reduced cross section tips. Further penetration is obtained by use with arrowhead tips having corresponding tapered surfaces merging into the surfaces between the blades mounted on the blade carrying body and sharp edges aligned with the blades. Further advantage in hunting applications is achieved with extending sharp edges being formed in the reduced area of the blade carrying body between adjacent blades, as shown in FIGS. 15 and 16. While shown in FIGS. 15 and 16 with respect to 2-bladed arrowheads, it is readily apparent that the corresponding sharp edges may be formed between any number of blades in accordance with arrowheads of this invention. In addition to serving as cutting edges, extending sharp edges 35 serve to further open the target volume.

The following specific examples are set forth to show the advantages of this invention utilizing specific embodiments and are not intended to limit the invention in any way.

EXAMPLES

All of the below tests were conducted in the same fashion for comparison of the penetration of various arrowheads. The arrowheads for each shooting were mounted on the same arrow shaft, 29½ inches long [measured according to standards set by Archery Manufacturer's Organization (AMO)] made from a Graphlex XT 18-8 shaft, fletched with three, 5 inch right hand helical feathers die cut to full contour. The arrow weight without the head was 450.5 grains. Prior to mounting the arrowheads on the arrow shafts, each test arrowhead was checked for alignment and the assembled arrowhead and shaft were also checked for alignment by free rotation providing a ready check of alignment for both the heads and the nocks.

Each shot was made using a shooting machine having a T.S.S. Quadraflex bow with a fixed draw force of 60 pounds and a draw length of 30 inches (AMO). A draw force curve was run prior to and following all of the examples and the stored energy was determined to be 65.59 foot pounds. A chronograph gate circuit was positioned 3 feet down range from the back of the bow. The distance between the back of the bow mounted in the shooting machine and the face of the target was 10 yards.

The target material was a polyethylene foam sold by Dow Chemical Company under the name Ethafoam 220. The foam was specified as 2.2 pounds per cubic foot density since low density target material is desired to magnify the effect of any differences in penetration. Each shot was made into virgin target material away from any hole or cut from a prior shot. The target was made up of four 4 inch thick 2 ft.×2 ft. slabs of foam mounted in a frame rigidly suspended at the desired target area. The frame was tightly clamped to bring the slab surfaces in close contact and to assure there were no voids in the target assembly.

Observation of each of the machine shots insured that the flight of the arrow was true and that all shots entered the target straight on. Nine acceptable shots were made with each specified arrowhead and questionable shots were not included in the compiled data. Only in the case of Example 5, eight shots were used in the data since one shot was judged questionable after the testing was complete. Penetration of the target was measured to the nearest 1/32 of an inch by measuring the projecting length of the arrow shaft after impact and subtracting this value from the overall length of the arrow. The results are shown in the table and will be discussed below:

| | Arrowhead | Head Weight Grains | Number Blades | Length/Width | Average Initial Velocity Feet/Sec. | Initial Kinetic Energy Ft-Lbs. | Bow Effic. % |
|---|---|---|---|---|---|---|---|
| Ex. 1 | THUNDERHEAD SLIMLINE | 124.8 | 3 | 1.45 | 198.6 | 50.395 | 76.83 |
| Ex. 2 | THUNDERHEAD MINI | 138.9 | 3 | 1.45 | 197.4 | 51.163 | 78.00 |
| Ex. 3 | THUNDERHEAD | 178.3 | 3 | 1.50 | 192.4 | 51.695 | 78.81 |
| Ex. 4 | THUNDERHEAD | 161.0 | 2 | 1.50 | 194.7 | 51.483 | 78.49 |
| Ex. 5 | RAZORBAK 4 (Heavy) | 225.6 | 4 | 1.96 | 186.9 | 52.453 | 79.97 |
| Ex. 6 | RAZORBAK 4 (Standard) | 139.1 | 4 | 1.96 | 197.6 | 51.130 | 77.95 |
| Ex. 7 | RAZORBAK 5 (Standard) | 142.2 | 5 | 2.20 | 197.3 | 51.244 | 78.12 |
| Ex. 8 | ROCKY MOUNTAIN | 126.9 | 3 | 1.47 | 199.2 | 50.886 | 77.58 |
| Ex. 9 | BOHNING BLAZER Flathead | 132.5 | 4 | 1.70 | 197.8 | 50.659 | 77.23 |
| Ex. 10 | BEAR RAZORHEAD Flathead | 132.2 | 2 | 1.85 | 197.3 | 50.376 | 76.80 |

| | | Penetration-Inches | | | | | | Penetration/ |
|---|---|---|---|---|---|---|---|---|
| | | Mean | | | | Deviation | | Kinetic Energy |
| | Arrowhead | Avg. | Median | Mode | Range | Std. | Max. | Inches/Ft-Lbs. |
| Ex. 1 | THUNDERHEAD SLIMLINE | 12.420 | 12.406 | 12.438 | 0.188 | 0.068 | 0.153 | 0.246 |
| Ex. 2 | THUNDERHEAD MINI | 11.927 | 11.969 | 11.969 | 0.125 | 0.035 | 0.083 | 0.233 |
| Ex. 3 | THUNDERHEAD | 11.712 | 11.688 | 11.688 | 0.156 | 0.049 | 0.087 | 0.227 |
| Ex. 4 | THUNDERHEAD | 12.184 | 12.188 | 12.188 | 0.250 | 0.079 | 0.153 | 0.236 |
| Ex. 5 | RAZORBAK 4 (Heavy) | 12.199 | 12.188 | 12.125 | 0.219 | 0.066 | 0.137 | 0.232 |
| Ex. 6 | RAZORBAK 4 (Standard) | 12.122 | 12.125 | 12.188 | 0.188 | 0.066 | 0.122 | 0.237 |
| Ex. 7 | RAZORBAK 5 (Standard) | 12.378 | 12.375 | 12.375 | 0.094 | 0.029 | 0.060 | 0.242 |
| Ex. 8 | ROCKY MOUNTAIN | 11.684 | 11.688 | 11.688 | 0.188 | 0.059 | 0.122 | 0.230 |
| Ex. 9 | BOHNING BLAZER Flathead | 12.170 | 12.188 | 12.219 | 0.125 | 0.047 | 0.076 | 0.240 |
| Ex. 10 | BEAR RAZORHEAD Flathead | 12.346 | 12.344 | 12.313 | 0.281 | 0.100 | 0.159 | 0.245 |

EXAMPLE 1

The THUNDERHEAD SLIMLINE had a blade carrying body of side configuration as shown in FIG. 4, a cross-sectional configuration as shown in FIG. 2, and a 4-sided tapered point as shown in FIG. 1, all of this application. The remainder of the arrowhead body, blades, and detachable nose portion were as described in U.S. Pat. No. 4,381,866, except that the blades had one full cutout shaped as shown by the two cutouts in the '866 patent without the central support. The arrowhead used in Example 1 gave the highest penetration and the most penetration per kinetic energy unit.

EXAMPLE 2

The arrowhead used in Example 2 was as shown in FIG. 2 of U.S. Pat. No. 4,381,866 having a blade carrying body of circular cross section with a straight taper from its front to rear end, the front end fairing into the point and the rear end fairing into the arrow shaft. The overall size, point and blades used in the THUNDERHEAD MINI of Example 2 were the same as the THUNDERHEAD SLIMLINE used in Example 1. An increase in penetration of over 4 percent is noted between the THUNDERHEAD SLIMLINE of Example 1 and the THUNDERHEAD MINI of Example 2, due primarily to the shape of the blade carrying body having a cross-sectional area less than that of a circumscribing circle having a center at the center of mass of the blade carrying body.

EXAMPLE 3

The THUNDERHEAD arrowhead used in Example 3 was a larger and heavier arrowhead having the same configuration as the arrowhead used in Example 2, except that the blades had two cutouts as shown in U.S. Pat. No. 4,381,866.

EXAMPLE 4

The THUNDERHEAD arrowhead used in Example 4 is of the same size and configuration as the arrowhead used in Example 3 except that it was a 2-bladed arrowhead.

EXAMPLE 5

The RAZORBAK 4 arrowhead used in Example 5 has a configuration as shown in FIGS. 1 and 4 of U.S. Pat. No. 4,006,901 except that it had four equally spaced solid blades, was weighted, and had a point as shown in FIGS. 7 and 8 of U.S. Pat. No. 4,093,230.

EXAMPLE 6

The RAZORBAK 4 arrowhead used in Example 6 was of the same size and configuration as the arrowhead used in Example 5 except it was lighter weight.

EXAMPLE 7

The RAZORBAK 5 arrowhead used in Example 7 had a configuration as shown in FIGS. 1, 2 and 4 of U.S. Pat. No. 4,006,901 and had a point as shown in FIGS. 7 and 8 of U.S. Pat. No. 4,093,230.

EXAMPLE 8

The ROCKY MOUNTAIN arrowhead used in Example 8 was similar in configuration and size to the arrowhead used in Example 2, having a tapered circular cross section blade carrying body extending for the full length of the blade and a conical point.

EXAMPLE 9

The BOHNING BLAZER arrowhead was a typical 4-bladed flathead not having a full length blade carrying body nor solid nose piece as the arrowheads used in Examples 1 through 8.

EXAMPLE 10

The BEAR RAZORHEAD flathead was a 2-bladed flat stamped sheet metal type arrowhead similar to the arrowhead used in Example 9 but having only 2 blades.

A portion of the material set forth above in Examples 1–7 as described in the article Scientific Broadhead Evaluation, Norb Mullaney, Archery World, February 1984, page 23 and 40–44, which is incorporated herein by reference in its entirety.

It is to be noted by comparison of the Examples that shape and not weight is the controlling factor in obtaining deeper penetration. By comparison of Examples 1 and 10, it is noted that a three blade arrowhead having a blade carrying body according to this invention has at least as great target penetration as a two blade flathead, and significantly deeper target penetration than a four blade flathead as shown by comparison of Examples 1 and 9. Comparison of Examples 1 and 2 show most directly the deeper penetration obtained by use of arrowhead bodies of this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In an arrowhead of the type having a separate, removable, tapered tip structure and a separate elongated blade carrying body in which a plurality of removable blades are mounted in blind slots, said separate, removable, tapered tip structure extending forwardly of said blades; the improvement comprising: said separate blade carrying body having for at least a portion of its length a reduced cross section area less than that of a circumscribing circle having a center at the center of mass of said separate blade carrying body at said section and a radius equal to the distance from said center to the junction of each of said blades with the surface of said separate blade carrying body, said cross section area being reduced from and providing less surface than said circumscribing circle between each two adjacent said blades at said cross section.

2. In an arrowhead of claim 1 wherein said reduced cross section area extends for at least 25 percent of the length of said blade carrying body.

3. In an arrowhead of claim 2 wherein the outer surface of said body between 3 to 5 adjacent blades having reduced cross section area is flat for a substantial portion of said surface.

4. In an arrowhead of claim 3 having multiple flat surfaces between said adjacent blades forming extending sharp edges.

5. In an arrowhead of claim 2 wherein the outer surface of said body between 3 to 5 adjacent blades having reduced cross section area is concave for a substantial portion of said surface.

6. In an arrowhead of claim 5 having multiple concave surfaces between said adjacent blades forming extending sharp edges.

7. In an arrowhead of claim 2 wherein the outer surface of said body between 3 to 5 adjacent blades having reduced cross section area is V-grooved for a substantial portion of said surface.

8. In an arrowhead of claim 7 having multiple V-grooved surfaces between said adjacent blades forming extending sharp edges.

9. In an arrowhead of claim 2 wherein the outer surface of said body between 3 to 5 adjacent blades having reduced cross section area is convex for a substantial portion of said surface.

10. In an arrowhead of claim 2 having 2 to 7 said blades.

11. In an arrowhead of claim 10 having 2 to 5 said blades.

12. In an arrowhead of claim 2 wherein said blade carrying body is a unitary structure with the forward end of an arrow shaft.

13. In an arrowhead of claim 2 wherein said blades are radially mounted in said blade carrying body.

14. In an arrowhead of claim 2 wherein said blades are non-radially mounted in said blade carrying body.

15. In an arrowhead of claim 2 wherein said separate, removable, tapered tip structure has a conical point.

16. In an arrowhead of claim 2 wherein said separate, removable, tapered tip structure has a tapered point of polygonal cross section with multiple cutting edges.

17. In an arrowhead of claim 16 wherein said polygonal cross section has a number of sides corresponding to the number of said blades and said sides are aligned with and faired into said outer surface of said front of said body between said blades.

18. In an arrowhead of claim 1 wherein said reduced cross section area extends for at least 60 percent of the length of said blade carrying body.

19. In an arrowhead of claim 18 wherein the cross-sectional area of said rear end of said blade carrying body is greater than said front end of said blade carrying body.

20. In an arrowhead of claim 19 wherein said blade carrying body has a narrow blade carrying portion adjacent each side of 2 to 7 said blade carrying slots, the outer surface of said body between adjacent blade carrying portions of adjacent blades is flat for a substantial portion of said surface.

21. In an arrowhead of claim 20 having multiple flat surfaces between said adjacent blade carrying portions forming extending sharp edges.

22. In an arrowhead of claim 19 wherein said blade carrying body has a narrow blade carrying portion adjacent each side of 2 to 7 blade carrying slots, the outer surface of said body between adjacent blade carrying portions of adjacent blades is concave for a substantial portion of said surface.

23. In an arrowhead of claim 22 having multiple concave surfaces between said adjacent blade carrying portions forming extending sharp edges.

24. In an arrowhead of claim 19 wherein said blade carrying body has a narrow blade carrying portion adjacent each side of 2 to 7 blade carrying slots, the outer surface of said body between adjacent blade carrying portions of adjacent blades is V-grooved for a substantial portion of said surface.

25. In an arrowhead of claim 24 having multiple V-grooved surfaces between said adjacent blade carrying portions forming extending sharp edges.

26. In an arrowhead of claim 19 wherein said blade carrying body has a narrow blade carrying portion adjacent each side of 2 to 7 blade carrying slots, the outer surface of said body between adjacent blade carrying portions of adjacent blades is convex for a substantial portion of said surface.

27. In an arrowhead of claim 19 wherein said arrowhead has a tip which has a conical point.

28. In an arrowhead of claim 19 wherein said arrowhead has a tip which has a tapered point of polygonal cross section, the number of sides of said polygonal section corresponding to the number of said blades.

29. In an arrowhead of claim 28 wherein said sides of said polygonal section are aligned with and faired into said outer surface of said front of said body between said blades.

30. In an arrowhead of claim 1 wherein said reduced cross section area extends for at least 80 percent of the length of said blade carrying body.

31. In an arrowhead of the type having a separate tip structure tapered in three dimensions and having tip attachment means at its rearward end and a separate elongated blade carrying body in which 3 to 7 blades are mounted and having mating attachment means at its forward end for receiving said tip attachment means, said tip structure extending forwardly of said blades; the improvement comprising: said separate blade carrying body having for at least 60 percent of its length a reduced cross section area less than that of a circumscribing circle having a center at the center of mass of said separate blade carrying body at said section and a radius equal to the distance from said center to the junction of each of said blades with the surface of said separate blade carrying body, said cross section area being reduced from and providing less surface than said circumscribing circle between each two. adjacent said 3 to 7 blades at said cross section.

32. In an arrowhead of claim 31 wherein the outer surface of said body between adjacent blades having reduced cross section area is flat for a substantial portion of said surface.

33. In an arrowhead of claim 31 wherein the outer surface of said body between adjacent blades having reduced cross section area is concave for a substantial portion of said surface.

34. In an arrowhead of claim 31 wherein the outer surface of said body between adjacent blades having reduced cross section area is V-grooved for a substantial portion of said surface.

35. In an arrowhead of claim 31 wherein the outer surface of said body between adjacent blades having reduced cross section area is convex for a substantial portion of said surface.

36. In an arrowhead of claim 31 wherein said separate tip is removably attached to said separate body.

37. In an arrowhead of claim 31 wherein said blade carrying body is a unitary structure with the forward end of an arrow shaft.

38. In an arrowhead of claim 31 wherein said blades are radially mounted in said blade carrying body.

39. In an arrowhead of claim 31 wherein said blades are non-radially mounted in said blade carrying body.

40. In an arrowhead of claim 31 wherein said arrowhead has a tip which has a tapered point of polygonal cross section with multiple cutting edges.

41. In an arrowhead of claim 40 wherein said polygonal cross section has a number of sides corresponding to the number of said blades and said sides are aligned with and faired into said outer surface of said front of said body between said blades.

42. In an arrowhead of the type having a separate tip structure tapered in three dimensions and having tip attachment means at its rearward end and a separate elongated blade carrying body in which a plurality of blades are mounted and having mating attachment means at its forward end for receiving said tip attachment means, said tip structure extending forwardly of said blades; the improvement comprising: said separate blade carrying body having for it full length a reduced cross section area less than that of a circumscribing circle having a center at the center of mass of said separate blade carrying body at said section and a radius equal to the distance from said center to the junction of each of said blades with the surface of said separate blade carrying body, said cross section area being reduced from and providing less surface than said circumscribing circle between each two adjacent said blades at said cross section.

43. In an arrowhead of claim 42 additionally having an arrow shaft and an adapter between said blade carrying body and the forward end of said arrow shaft wherein said surface of said reduced cross-section area continues rearwardly into said adapter.

44. In an arrowhead of claim 43 wherein said surface of said reduced cross-sectional area continues for the full length of said adapter.

45. In an arrowhead of claim 44 wherein said surface of said reduced cross-sectional area continues rearwardly into said forward end of said arrow shaft.

46. In an arrowhead of claim 42 wherein said surface of said reduced cross-sectional area continues rearwardly into the forward end of an arrow shaft.

47. In an arrowhead of claim 42 wherein said separate tip is removably attached to said separate body.

48. In an arrowhead of claim 42 wherein the outer surface of said body between adjacent blades having reduced cross section area is flat for a substantial portion of said surface.

49. In an arrowhead of claim 42 having 3 to 5 said blades.

50. In an arrowhead of claim 42 wherein said separate tip has a tapered point of polygonal cross section said polygonal cross section has a number of sides corresponding to the number of said blades and said sides are aligned with and faired into said outer surface of said front of said body between said blades.

* * * * *